United States Patent [19]

Broderick et al.

[11] Patent Number: 4,709,523

[45] Date of Patent: Dec. 1, 1987

[54] INSULATION BATT WITH PRESS-ON FACING FLANGES

[75] Inventors: Thomas B. Broderick, Granville; Donald J. Algrim, Reynoldsburg; Richard F. Hayden, Columbus, all of Ohio

[73] Assignee: Owens-Corning Fiberglas Corporation, Toledo, Ohio

[21] Appl. No.: 897,454

[22] Filed: Aug. 18, 1986

[51] Int. Cl.[4] ..... E04B 1/88

[52] U.S. Cl. ..... 52/406; 52/409; 52/420; 428/58; 428/124; 428/126; 428/192; 428/354

[58] Field of Search ..... 52/406, 409, 420; 428/58, 124, 126, 192, 354

[56] References Cited

U.S. PATENT DOCUMENTS

| | | | |
|---|---|---|---|
| 2,913,104 | 11/1959 | Parker | 52/406 |
| 3,111,787 | 11/1963 | Chamberlain | 52/420 |
| 3,121,649 | 2/1964 | Oliver | 52/420 |
| 3,307,306 | 3/1967 | Oliver | 52/409 |
| 3,729,879 | 5/1973 | Franklin | 52/406 |

FOREIGN PATENT DOCUMENTS 6506245 11/1966 Netherlands .

*Primary Examiner*—James C. Cannon

[57] ABSTRACT

The insulation batt has a facing with a facing flange, the facing flange having pressure-sensitive adhesive thereon and being folded inwardly to engage the pressure-sensitive adhesive with a release strip on the inside of the facing and dispose the facing flange flush with an edge of the batt. For installation of the batt, the facing flange is unfolded outwardly to expose the pressure-sensitive adhesive.

10 Claims, 8 Drawing Figures

INSULATION BATT WITH PRESS-ON FACING FLANGES

TECHNICAL FIELD

This invention relates generally to thermal insulation, and more particularly to insulation batts with pressure-sensitive adhesive on flanges of the facing material.

BACKGROUND ART

U.S. Pat. No. 2,913,104, issued to Konrad Parker on Nov. 17, 1959, discloses a fully enclosed insulation batt with pressure-sensitive adhesive on facing flanges, the flanges being adhered to faced edges of the batt during shipment and storage and being adapted to be pressed on studs of building walls when being installed.

U.S. Pat. No. 3,307,306, issued to Robert E. Oliver on Mar. 7, 1967, discloses insulation blankets faced on one side and used for ceilings of metal buildings, with pressure-sensitive adhesive on facing flanges and facing edges for adhering blankets to each other at adjacent edges.

U.S. Pat. No. 3,729,879, issued to Andrew T. Franklin on May 1, 1973, discloses a fully enclosed insulation batt with pressure-sensitive adhesive on facing flanges, covered by release paper.

DISCLOSURE OF INVENTION

In accordance with the invention, an insulation batt faced on one side, having pressure-sensitive adhesive on flanges of the facing material, and having a unique configuration of the facing material during storage and shipment of the faced batt, is provided.

BRIEF DESCRIPTION OF THE DRAWINGS

The invention is more fully explained hereinafter, reference being had to the accompanying drawings in which.

BEST MODE OF CARRYING OUT THE INVENTION

Figure 1:
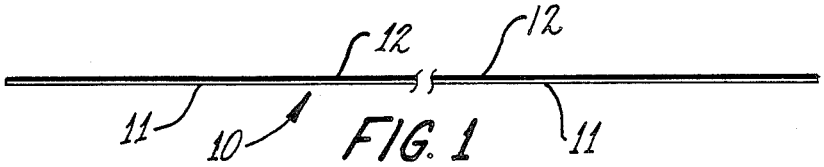
FIGS. 1–4 are fragmentary schematic cross-sectional views of facing material showing successive steps in the fabrication thereof into the configuration of the invention.
Figure 2:
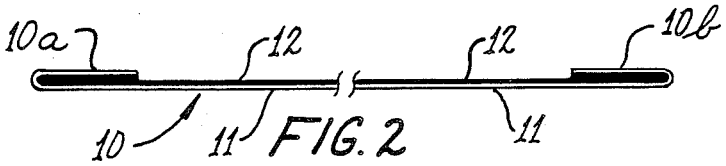
Figure 3:
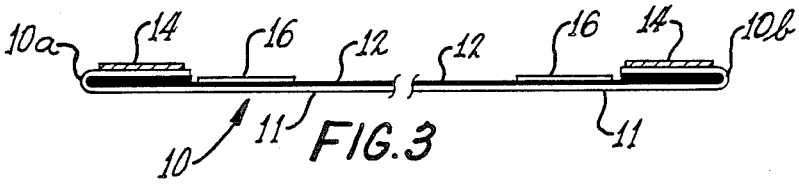
Figure 4:
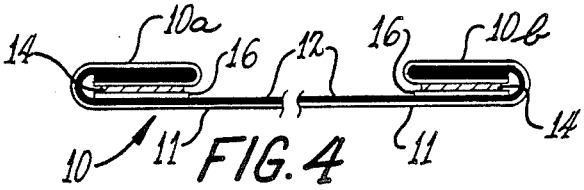
Figure 5:
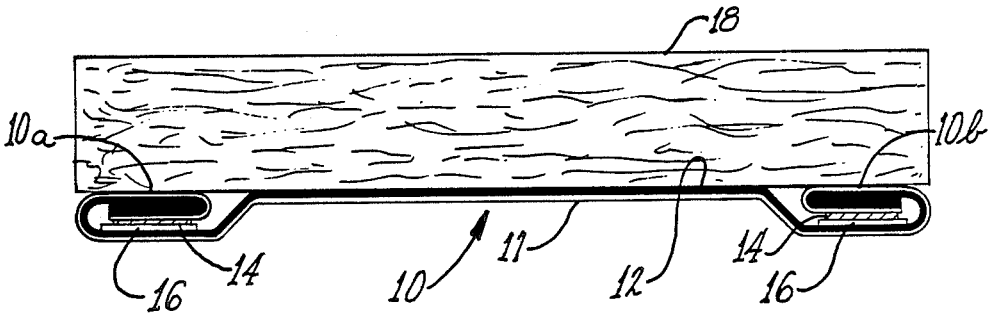
FIG. 5 is a schematic cross-sectional view of a fibrous insulation batt having a facing configured in accordance with the invention.

With reference to the drawings, FIG. 1 shows a facing material 10 comprising a sheet 11 coated on one side with a hot melt laminating adhesive 12 such as asphalt. FIG. 2 shows the facing material 10 of FIG. 1 after opposite longitudinal edge portions thereof have been folded inwardly through 180° to provide a pair of double-thickness facing flanges 10*a* and 10*b*. FIG. 3 shows the facing material 10 of FIG. 2 after pressure-sensitive adhesive 14 has been applied to the facing flanges 10*a* and 10*b* and release strips 16 have been adhered to the sheet 11 by the laminating adhesive 12 respectively adjacent the facing flanges 10*a* and 10*b*. FIG. 4 shows the facing material 10 of FIG. 3 after the facing flanges 10*a* and 10*b* have been folded inwardly to place the pressure-sensitive adhesive 14 in engagement with the release strips 16. Each of the release strips 16 has a coating of release agent (not shown) on a surface thereof facing the pressure-sensitive adhesive 14. FIG. 5 shows the facing material 10 of FIG. 4 adhered to a major surface of a fibrous insulation batt 18 by the portion of laminating adhesive 12 disposed between the release strips 16. After application of the facing material 10 to the batt 18, the laminating adhesive 12 cools and hardens. As shown in FIG. 5, the facing material 10 is in the configuration it has for packaging, storage, and shipment of the faced batt.

Figure 6:
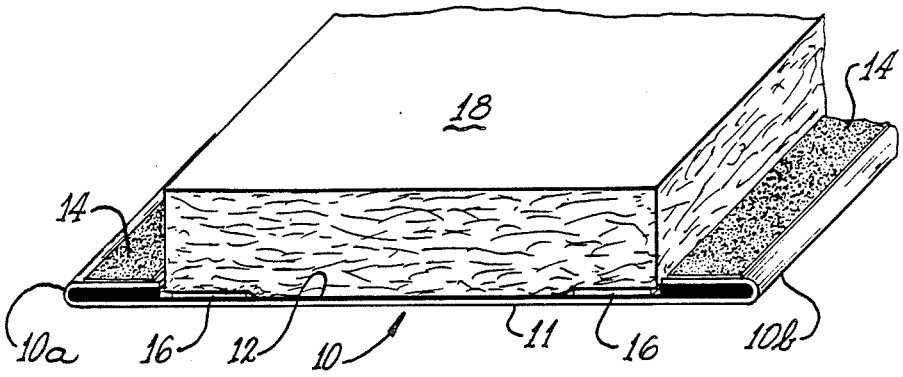
FIG. 6 is an isometric view of the faced batt of FIG. 5, but with the facing flanges unfolded out to expose pressure-sensitive adhesive thereon for installation purposes.

FIG. 6 shows the faced batt of FIG. 5, but with the facing flanges unfolded to expose the pressure-sensitive adhesive 14, as when it is desired to install the batt between a pair of metal studs.

Figure 7:
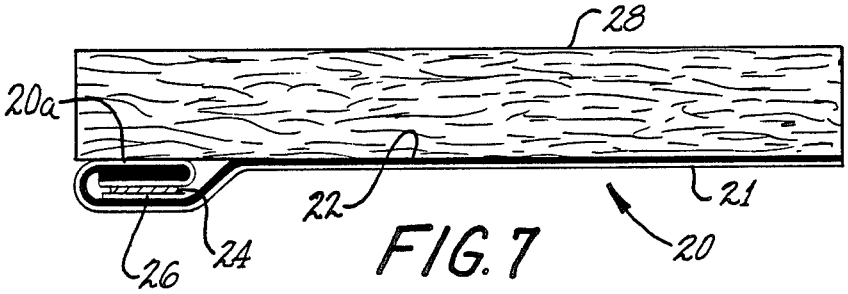
FIG. 7 is a cross-sectional view similar to FIG. 5, but illustrating a modification of the faced insulation batt.

In some instances, only one facing flange may be necessary. FIG. 7 shows a modification of the faced batt of FIG. 5. A fibrous insulation batt 28 has a facing 20 thereon including a sheet 21 and a hot melt laminating adhesive 22 such as asphalt thereon. One edge of the facing 20 is folded inwardly to provide a double-thickness facing flange 20*a*, pressure-sensitive adhesive 24 is applied to the facing flange 20*a*, a release strip 26 is applied to the sheet 21 and adhered thereto by the laminating adhesive 22 adjacent the facing flange 20*a*, the facing flange 20*a* is folded inwardly to place the adhesive 24 in engagement with the release strip 26, and the facing 20 is then adhered to the batt 28 by that portion of the adhesive 22 not covered by the facing flange 20*a*.

Figure 8:
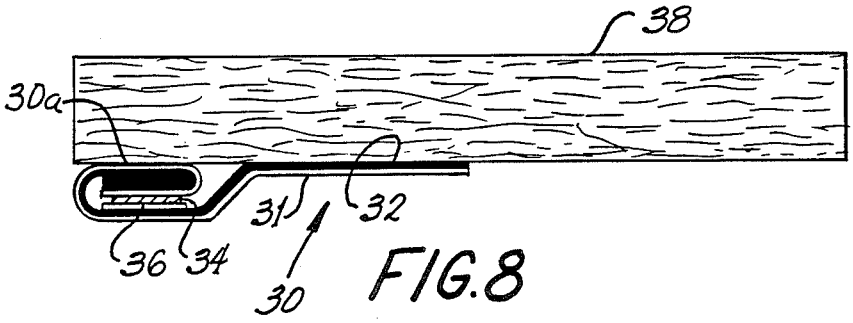
FIG. 8 is a cross-sectional view similar to FIG. 5, but illustrating another modification of the faced insulation batt.

In some instances, it is not necessary that the facing cover the major surface of the batt for the full width. FIG. 8 shows a fibrous insulation batt 38 having a facing 30 thereon adjacent one edge of a major surface thereof. The facing 30 includes a sheet 31 and hot melt laminating adhesive 32 such as asphalt thereon. One edge of the facing 30 is folded inwardly to provide a double-thickness facing flange 30*a*, pressure-sensitive adhesive 34 is applied to the facing flange 30*a*, a release strip 36 is applied to the sheet 31 and adhered thereto by the adhesive 32 adjacent the facing flange 30*a*, the facing flange 30*a* is folded inwardly to place the adhesive 34 in engagement with the release strip 36, and the facing 30 is then adhered to the batt 38 by that portion of the adhesive 32 not covered by the facing flanges 30*a*, in such a manner as to make the inwardly folded facing flange 30*a* flush with one edge of the batt 38. The facing 30 may extend only about half way across the full width of the batt 38.

In the embodiments of FIGS. 7 and 8, the facing sheets 21 and 31 are preferably kraft paper. In the embodiment of FIGS. 1 to 6, the facing sheet 11 is preferably laminated aluminum foil, glass scrim, and kraft paper. The insulation batts 18, 28, and 38 are preferably fibrous glass.

Various other modifications may be made in the structure shown and described without departing from the spirit and scope of the invention.

We claim:

1. Faced insulation comprising a fibrous insulation batt, a facing having a facing flange normally extending transversely outwardly from an edge of the batt when in a condition for installation of the batt, pressure-sensitive adhesive on a side of the facing flange adjacent the batt when the facing flange is extended outwardly form the edge of the batt, and a release strip on an inner side of the facing inwardly of but adjacent said facing flange, the facing flange being folded inwardly between the batt and the remainder of the facing when in a condition for storage and shipment of the faced insulation, with the pressure-sensitive adhesive in engagement with said release strip, the facing transversely inwardly of the inwardly folded facing flange being adhered to a major surface of the batt.

2. Faced insulation as claimed in claim 1 wherein the facing extends from the inwardly folded facing flange to an opposite edge of said batt.

3. Faced insulation as claimed in claim 1 wherein the facing extends from the inwardly folded facing flange only part of the way to an opposite edge of the batt.

4. Faced insulation as claimed in claim 1 wherein the facing has an opposite second facing flange with pressure-sensitive adhesive thereon and a second release strip on the inner side thereof inwardly of but adjacent the second facing flange, the second facing flange being folded inwardly with the pressure-sensitive adhesive thereon in engagement with the second release strip.

5. Faced insulation as claimed in claim 1 wherein the batt comprises glass fibers.

6. A faced insulation batt comprising a facing and a fibrous batt, the facing including a facing sheet and laminating adhesive on an inner side thereof, one edge portion of the facing being folded inwardly to provide a double-thickness facing flange with said laminating adhesive between two thicknesses thereof, pressure-sensitive adhesive on said inwardly folded edge portion on a side thereof opposite said laminating adhesive, and a release strip adhered to the laminating adhesive adjacent the facing flange, the facing flange being folded inwardly and the pressure-sensitive adhesive being in engagement with said release strip, and the laminating adhesive on the facing sheet inwardly of the inwardly folded facing flange securing the facing to a major surface of the fibrous batt with the inwardly folded facing flange substantially flush with one edge of the batt.

7. A faced insulation batt as claimed in claim 6 wherein the facing extends from the one edge of the batt to an opposite edge of the batt.

8. A faced insulation batt as claimed in claim 6 wherein the facing extends from the one edge of the batt only part of the way to an opposite edge of the batt.

9. A faced insulation batt as claimed in claim 6 wherein the facing has an opposite second facing flange with pressure-sensitive adhesive thereon and a second release strip on the inner side thereof inwardly of but adjacent the second facing flange, the second facing flange being folded inwardly with the pressure-sensitive adhesive thereon in engagement with the second release strip.

10. A faced insulation batt as claimed in claim 6 wherein the batt comprises glass fibers.

* * * * *